US005779073A

United States Patent [19]

Milhomme

[11] Patent Number: 5,779,073

[45] Date of Patent: Jul. 14, 1998

[54] CAP FOR A CORKED GLASS BOTTLE

[75] Inventor: Didier Milhomme, Sevrier, France

[73] Assignee: Societe Alsacienne d'Aluminium, Saint Julien en Genevois, France

[21] Appl. No.: 729,398

[22] Filed: Oct. 11, 1996

[30] Foreign Application Priority Data

Oct. 12, 1995 [FR] France ..... 95 11974

[51] Int. Cl.[6] ..... B65D 39/00

[52] U.S. Cl. ..... 215/232; 215/349

[58] Field of Search ..... 215/232, 341, 215/349, 364

[56] References Cited

U.S. PATENT DOCUMENTS

| | | | |
|---|---|---|---|
| 2,413,449 | 12/1946 | Hatch | 215/232 X |
| 4,130,213 | 12/1978 | Wazolek | 215/349 |
| 4,394,917 | 7/1983 | Looser | 215/232 |
| 4,396,655 | 8/1983 | Graham et al. | 215/232 X |
| 4,527,703 | 7/1985 | Cummings | 215/232 |
| 4,560,566 | 12/1985 | Roth | 215/232 X |

FOREIGN PATENT DOCUMENTS

| | | |
|---|---|---|
| 0615915 | 9/1994 | European Pat. Off. . |
| 2420489 | 10/1979 | France . |
| 1955161 | 5/1971 | Germany . |

*Primary Examiner*—Stephen Cronin
*Attorney, Agent, or Firm*—Shenier & O'Connor

[57] ABSTRACT

A cap for the neck of a corked glass bottle constructed as a single piece by stamping a thin sheet of material having one or more layers. The sheet has at least one gas-impervious layer. The cap includes a planar portion, the lower surface of which contacts and remains unadhered to the upper surface of the neck. Depending from the periphery of the planar portion is an annular skirt. A heat-sensitive adhesive adheres the inner surface of the skirt to the annular outer surface of the neck upon heating. In a second embodiment, the adhesive layer covers the entire inner and lower surfaces of the cap. A disk is adhered to the inner surface to prevent the upper surface of the neck from contacting the adhesive.

6 Claims, 2 Drawing Sheets

CAP FOR A CORKED GLASS BOTTLE

The present invention relates to a cap for capping the neck of a bottle made of glass.

BACKGROUND OF THE INVENTION

Such caps are used in particular for capping the necks of bottles containing wine or alcohol and that have previously been closed by means of a cork. In general, such caps comprise a top disk and a skirt bonded to the periphery of the disk.

Document FR-A-93 03 123 provides for making the disk in the form of a dish having a rim, the skirt and the disk being bonded together by adhesive via the rim of the dish.

That skirt is in the form of a truncated cone and it is pressed against the peripheral wall of the bottle neck by calendaring. Unfortunately, the calendaring operation is difficult to perform when the bottle neck has a lip ring of a diameter that is considerably greater than the diameter of the bottle neck and/or the calendaring operation is unsuitable for pressing the skirt against said neck to make it pleasing in appearance.

Plane caps are also known that can be fitted to the end faces of glass receptacles by heating, such a cap including on its bottom face a layer of material that adheres to glass on being heated.

Such plane caps are not suitable for capping bottles of wine that have previously been closed with stoppers made of cork or the like, since prior to uncorking a bottle, it is the practice to remove all of that portion of the cap which covers the end face, e.g. by cutting the periphery thereof with a knife.

OBJECT AND BRIEF SUMMARY OF THE INVENTION

The object of the present invention is to provide a cap that can be durably attached and sealed to any type of glass bottle by heating, and whose top portion does not adhere to the top face of the bottle neck.

The invention thus provides a cap for capping the neck of a glass bottle, in particular a bottle previously closed by a cork.

According to the invention, the cap is made as a single piece by stamping a thin sheet of single or multi-layer material to form a disk whose bottom face contacts the end face of the neck, and an annular rim at the periphery of said disk, the inside face of said rim contacting the peripheral surface of said neck in the vicinity of said end face. The rim includes on its inside face a layer of adhesive material suitable, on being heated, for adhering to glass, and said disk presenting on its bottom face a material that does not adhere to glass.

In a first embodiment, the cap includes at least one sheet of a material that is gas-impermeable and the layer of adhesive material is applied in the form of a fillet to the concave face of said sheet in the region of the rim.

In a second embodiment, the cap includes at least one sheet of a material that is gas-impermeable and the layer of adhesive material is applied to the entire concave surface of said sheet, a patch that does not adhere to glass also being provided on the bottom face of the disk to cover the top of the bottle neck.

BRIEF DESCRIPTION OF THE DRAWINGS

Other advantages and characteristics of the invention appear on reading the following description given by way of example and made with reference to the accompanying drawings, in which.

MORE DETAILED DESCRIPTION

Figure 1:
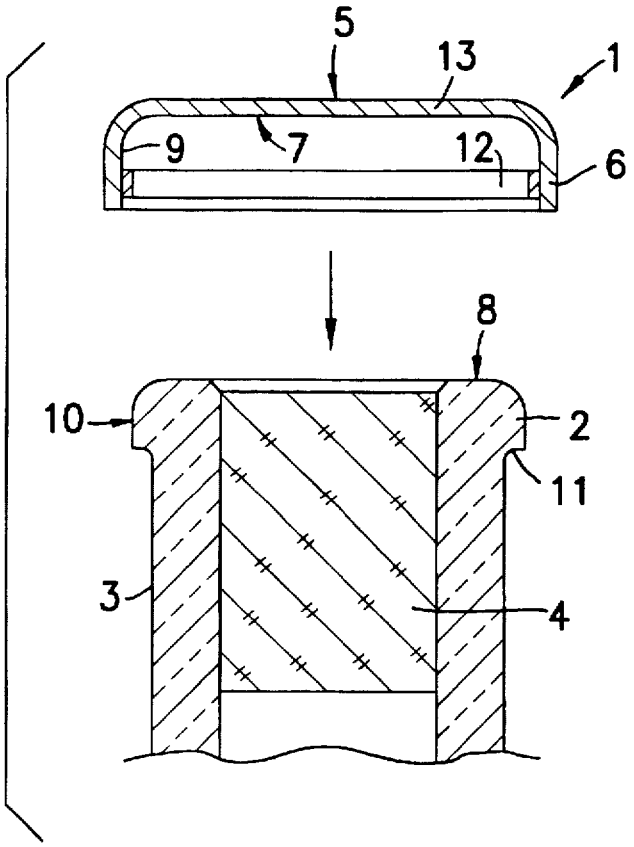
FIG. 1 shows a cap constituting a first embodiment of the invention together with the neck of a bottle onto which the cap fits.

Reference 1 designates a cap for capping the top end 2 of the neck 3 of a glass bottle that has previously been closed by a cork 4, said bottle containing wine, in particular.

The cap 1 is made as a single piece by stamping so as to present a plane disk 5 and an annular rim 6 at the periphery of the disk 5. The dimensions of the disk 5 and of the rim 6 are adapted to the dimensions of the neck 3 that is to receive it, in such a manner that the bottom face 7 of the disk 5 can come into contact with the end face 8 of the neck 3, and the bottom face 9 of the rim 6 is in contact with the peripheral wall 10 of said bottle neck in the vicinity of the end face 8. The height of the rim 6 is a function of the shape of the bottle neck 3, and possibly of the height of the lip ring 11 of the neck 3 when said ring 11 is in the immediate vicinity of the end face 8 of the neck 3.

According to the present invention, the inside face 9 of the rim 6 is coated in a layer 12 of adhesive material suitable on being heated for adhering to glass, and the bottom face 7 of the disk 5 has a material that, on being heated, does not adhere to glass.

Figure 2:
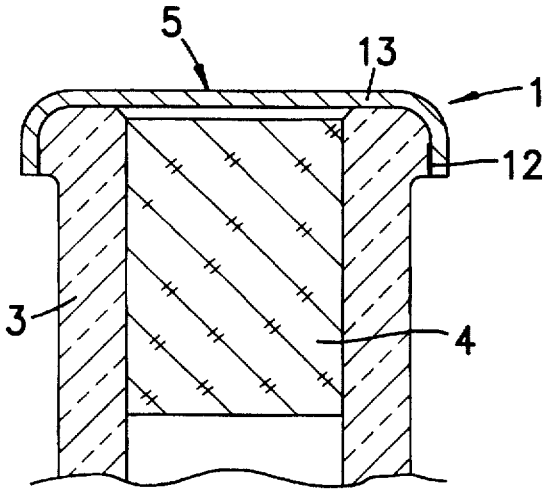
FIG. 2 shows the cap of FIG. 1 fixed to the neck of the bottle.

In a first embodiment, as shown in FIGS. 1 and 2, the adhesive layer 12 is applied in the form of an annular fillet to the rim region 6 of the concave face of the cap 1, the cap including at least one inner sheet 13 of gas-impermeable material such as aluminum, tin, PVC, polystyrene, polypropylene, or polyester, to which the layer 12 of adhesive is applied.

Figure 3:
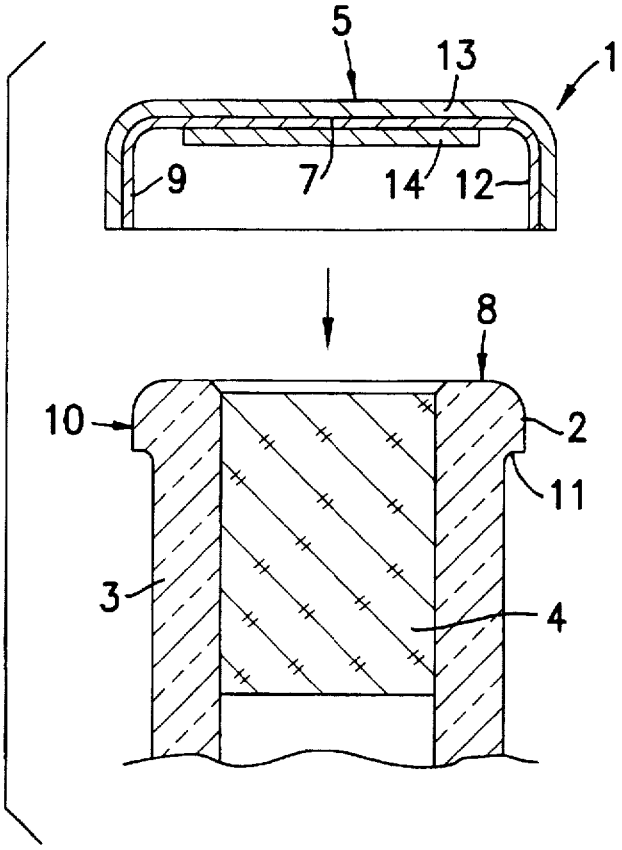
FIG. 3 shows a cap constituting a second embodiment of the invention together with a bottle neck.
Figure 4:
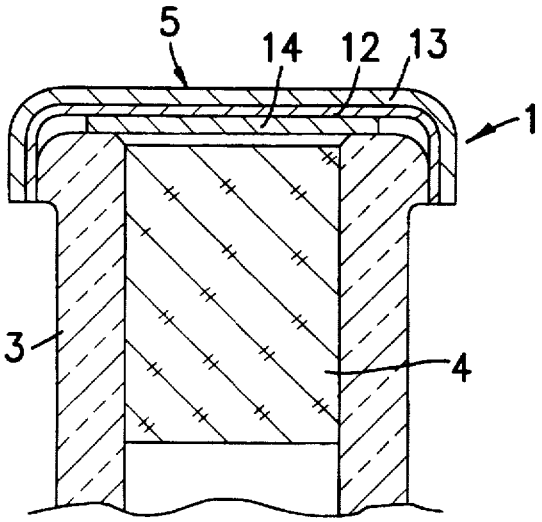
FIG. 4 shows the cap of FIG. 3 fixed to the neck of the bottle.

In a second embodiment, shown in FIGS. 3 and 4, the cap 1 includes at least an inner sheet 13 of a gas-impermeable material such as aluminum, tin, PVC, polystyrene, polypropylene, or polyester. The concave face of this sheet 13 is coated over its entire area with a layer 12 of adhesive that is capable on being heated of adhering to glass. Also provided on the bottom face 7 of the disk 5 is a patch 14 of material that adheres to the adhesive of the layer 12 but that does not adhere to glass on being heated.

In general, the adhesive of the layer 12 is selected from extrudable adhesives. These can belong to two families of substances:

- extrudable hot melt adhesives which transform at temperatures in the range 100° C. to 250° C. and which contain copolymers based on vinyl ester, e.g. ethylene-vinyl acetate (EVA) or ethylene-methyl acrylate (EMA); and
- mixtures based on acid copolymers and on ionomer resins extrudable at temperatures in the range 200° C. to 300° C. By way of example, these substances may include mixtures of copolymers of ethylene and of acid monomers (acrylic, methacrylic, etc., . . . ) or ionomer resins obtained therefrom.

The cap 1 is preferably made from a sheet or strip comprising a multilayer laminate preferably having two sheets of aluminum disposed on either side of a sheet of polyethylene. The weight of the polyethylene sheet preferably lies in the range 30 g/m$^2$ to 80 g/m$^2$. The thicknesses of the aluminum sheets lie in the range 8 micrometers to 100 micrometers. Preferably, the aluminum sheet on the inside of the cap is 12 micrometers thick, the polyethylene sheet weighs 50 g/m$^2$, and the thickness of the outer aluminum sheet is 25 micrometers. This type of laminate avoids creases when the cap 1 is crimped onto the bottle neck 3.

The cap 1 is put into place on the neck 3 as follows: the cap 1 is placed on the neck 3, and is then heated with a heater device to a temperature enabling the adhesive to adhere to glass. This adhesion takes place at the fillet of adhesive when using the cap 1 of the first embodiment, or at the rim 6 when using the cap 1 of the second embodiment.

I claim:

1. A bottle cap and bottle combination comprising (i) a glass bottle provided with a neck having an upper surface and an annular side surface in close proximity to said upper surface and (ii) a bottle cap including a thin member having a circular planar portion and a depending peripheral skirt portion, said planar portion having a lower surface, means including said planar portion for contacting the upper surface with a material having substantially no adhesive properties, and said skirt portion having an inner surface which is directly adhered to the side surface by a heat-activated adhesive in contact therewith.

2. The cap of claim 1, wherein said thin member comprises a single gas-impermeable layer.

3. The cap of claim 1, wherein said thin member comprises a plurality of layers at least one of which is gas-impermeable.

4. The cap of claim 1, wherein said adhesive comprises a thin annular ring adhered to said inner and side surfaces.

5. A cap for the neck of a glass bottle, the neck having an upper surface and an annular side surface, including in combination a thin member having a circular planar portion and a depending peripheral skirt portion, said planar portion having a lower surface, a thin disk substantially coextensive with and adhered to said lower surface by a heat-activated adhesive, said thin disk contacting the upper surface with substantially no adhesion thereto, and said skirt portion having an inner surface which is adhered to the side surface by a heat-activated adhesive in contact therewith.

6. The cap of claim 5, wherein the adhesive comprises a thin layer covering both of said lower and inner surfaces of said member.

* * * * *